US010334940B2

(12) United States Patent
Kayser

(10) Patent No.: US 10,334,940 B2
(45) **Date of Patent: *Jul. 2, 2019**

(54) COMPOSITE HEAD TOOTHBRUSH HAVING SAFETY FEATURES

(71) Applicant: Steven L. Kayser, San Diego, CA (US)

(72) Inventor: Steven L. Kayser, San Diego, CA (US)

(73) Assignee: Loops LLC, Ferndale, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/854,097

(22) Filed: Dec. 26, 2017

(65) Prior Publication Data

US 2018/0125219 A1 May 10, 2018

Related U.S. Application Data

(63) Continuation-in-part of application No. 14/099,637, filed on Dec. 6, 2013, now abandoned, which is a continuation-in-part of application No. 11/653,153, filed on Jan. 12, 2007, now Pat. No. 9,066,583, which is a continuation-in-part of application No. 11/563,671, filed on Nov. 27, 2006, now Pat. No. 8,448,285.

(51) Int. Cl.

| | |
|---|---|
| ***A46B 5/02*** | (2006.01) |
| ***A46B 9/04*** | (2006.01) |
| ***A46B 5/00*** | (2006.01) |
| ***A46B 15/00*** | (2006.01) |

(52) U.S. Cl.

CPC ..... *A46B 5/0075* (2013.01); *A46B 5/02* (2013.01); *A46B 9/04* (2013.01); *A46B 15/0081* (2013.01); *A46B 2200/1066* (2013.01)

(58) Field of Classification Search

CPC ..... A46B 5/02; A46B 5/0075; A46B 15/0081; A46B 2200/1066; A46B 9/04

See application file for complete search history.

(56) References Cited

U.S. PATENT DOCUMENTS

| | | | | | |
|---|---|---|---|---|---|
| 1,645,965 | A | * | 10/1927 | Neumerkel | A46B 5/04 15/167.1 |
| 1,717,125 | A | * | 6/1929 | Spitz | A46B 7/04 15/176.4 |
| 1,875,476 | A | * | 9/1932 | McNally | A46B 7/04 15/176.4 |
| 1,908,510 | A | | 5/1933 | Dodson | |

(Continued)

FOREIGN PATENT DOCUMENTS

| | | | |
|---|---|---|---|
| DE | 36 28 722 | * | 2/1988 |
| DE | 19624962 A1 | | 1/1998 |

(Continued)

*Primary Examiner* — Randall E Chin
(74) *Attorney, Agent, or Firm* — Timothy W. Fitzwilliam

(57) ABSTRACT

A composite head safety toothbrush is disclosed. The toothbrush apparatus detailed herein employs a composite head made from a rigid inner polymer material and a softer thermoplastic material surrounding the inner material. The softer material provides safety for prison toothbrush applications as well as elderly and patient care where care givers may brush the teeth of a patient. Innovative pin connectors in the inner toothbrush head assist in the composite formation. The toothbrush solution herein further importantly provides for a toothbrush having a flexible handle.

6 Claims, 3 Drawing Sheets

(56) References Cited

U.S. PATENT DOCUMENTS

| | | | | |
|---|---|---|---|---|
| 1,945,559 | A | 2/1934 | McNally | |
| 5,291,878 | A | 3/1994 | Lombardo et al. | |
| 5,630,244 | A | 5/1997 | Chang | |
| 5,864,915 | A | 2/1999 | Ra | |
| 6,276,020 | B1 | 8/2001 | Leversby et al. | |
| 6,295,686 | B1 | 10/2001 | Phillips | |
| 6,298,516 | B1 | 10/2001 | Beals et al. | |
| 6,546,583 | B1 | 4/2003 | Rohrig | |
| 6,668,416 | B1 | 12/2003 | Georgi et al. | |
| 7,334,286 | B2 | 2/2008 | Kayser | |
| 8,448,285 | B2 * | 5/2013 | Kayser ..... | A46B 5/0075 15/143.1 |
| 2003/0208870 | A1 | 11/2003 | Jimenez | |
| 2012/0324664 | A1 | 12/2012 | Carpenter | |

FOREIGN PATENT DOCUMENTS

| | | |
|---|---|---|
| EP | 0336641 | 11/1989 |
| WO | 0015077 | 3/2000 |

* cited by examiner

COMPOSITE HEAD TOOTHBRUSH HAVING SAFETY FEATURES

PRIORITY CLAIM

This patent application is a continuation-in-part, and therefore contains subject matter claiming benefit of the priority date of pending U.S. patent application Ser. No. 14/099,637 filed on Dec. 6, 2013 and entitled METHOD FOR MAKING SAFETY TOOTHBRUSHES now abandoned, which in turn is a continuation-in-part of U.S. patent application Ser. No. 11/653,153 filed on Jan. 12, 2007 and entitled, PACKAGED TOOTHBRUSH AND TOOTHBRUSH CONTAINER AND METHODS OF MAKING SAME, now U.S. Pat. No. 9,066,583; which is further a continuation-in-part of, and claims benefit of the priority date of U.S. patent application Ser. No. 11/563,671, now U.S. Pat. No. 8,448,285 filed on Nov. 27, 2006 and entitled TOOTHBRUSH AND METHODS OF MAKING AND USING SAME, accordingly, the entire contents of these patent applications are hereby expressly incorporated by reference.

BACKGROUND OF THE INVENTION

Field of the Invention

The present invention pertains generally to toothbrush devices. More specifically, the invention relates to a composite head toothbrush with safety features particularly useful for prisons, hospitals and patient/elderly care.

Description of the Prior Art

Prisons and other detention systems restrict certain hygiene items used by inmates to prevent the use of an otherwise safe device as a weapon. For example, conventional toothbrushes are not permitted to be used by many prison systems because they may be fashioned into a pointed shaft or rod or otherwise known as a shank, which could be used to endanger other inmates or themselves, as well as security personnel. Psychiatric and other mental health systems likewise require toothbrushes that cannot cause self-injury or harm to care givers or security personnel.

A previous attempt to provide a safe alternative toothbrush for use by inmates was a toothbrush simply having a brush head and a very short handle. However, such handle is so short that it must be grasped by only the thumb and forefinger of the user. Hence, this toothbrush is awkward to use. The fingers of the user may be required to enter the mouth to reach all of the teeth. Such a difficult to use toothbrush may only provide marginal teeth cleaning and be uncomfortable to use. Further ineffectual cleaning procedures may cause, or at the least contribute to, poor dental hygiene, thereby leading to costly dental procedures in some instances.

Toothbrushes having a flexible handle, therefore deterring inmates' ability to fashion into a shank have further been heretofore known. One such example was proposed by inventor Phillips, entitled "Flexible Toothbrush," U.S. Pat. No. 6,295,686. This particular design has a handle portion, reference character sixteen, that is flexible. The handle portion is further coupled to a neck portion, reference character fourteen. The material used in the toothbrush design additionally comprises 50% thermoplastic rubber and 50% polypropylene. As compared to Philips however, the present invention incorporates added design benefits that improve wear characteristics and facilitate use.

Also of concern in the technical field is a bristle retention requirement. Particularly, the bristles must remain secured in place for reasonable longevity. This is of particular concern for prison toothbrushes because bristle retention is very poor when configured to flexible material. Accordingly, present inventor has experimented with composite toothbrush head designs. A related example is provided by Leversby et al., entitled "Toothbrush Structure," U.S. Pat. No. 6,276,020. Leversby and his co-inventors describe a toothbrush design with two materials included in the molding process to generally improve strength of the toothbrush and provide a non-slip surface for grasping. There remains a need, however, for a toothbrush head being resilient for strength and bristle retention but however having an outer softer material.

BRIEF SUMMARY OF THE INVENTION

The present invention specifically addresses and alleviates the above mentioned deficiencies associated with the prior art. More particularly, the present invention in a one aspect, is directed to a toothbrush having a composite head, the composite head comprising: a rigid inner core having a plurality of bristle holes for retention and holding a plurality of toothbrush bristles, the rigid inner core made from a $1^{st}$ material; and a pliable flexible material substantially or entirely surrounding the rigid inner core on a left and a right side in the bottom plan view underside aspect, the pliable flexible material being made from a $2^{nd}$ material.

Still further the invention in this aspect may be characterized wherein the composite head further comprises a tip of the rigid inner core being covered with the pliable flexible material; and an end of the rigid inner core opposite the tip further having the pliable flexible material adjacent thereto. Also further the composite head has an opposite side of the rigid inner core, the opposite side opposing a side having the plurality of bristle holes, the opposite side substantially covered by pliable flexible material. And further the composite head has a pair of pin connectors extending from the opposite side of the toothbrush head, the toothbrush head thereby being substantially encased by the pliable flexible material with the exception of the pin connectors and the side having the plurality of bristles not being fully encased in the pliable flexible material.

Yet further, the invention in this aspect may be characterized wherein the pair of pin connectors are offset diagonally with respect to a longitudinal axis of the toothbrush, the longitudinal axis being equidistance to each of the pair of pin connectors. Another feature of the invention is that the composite head toothbrush has a flexible handle at least partially made from the $2^{nd}$ material, the pliable material, the toothbrush further thereby being a safety toothbrush. Still further, the flexible handle further includes an enlarged curvilinear flat rear end portion wherein further the toothbrush is able to be flexed into substantially a "L" or "C" shape.

These, as well as other advantages of the present invention will be more apparent from the following description and drawings. It is understood that changes in the specific structure shown and described may be made within the scope of the claims, without departing from the spirit of the invention, such as a variety of positions for pin placement as described herein.

The invention can be better visualized by turning now to the following drawings wherein like elements are referenced by like numerals.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION OF THE PREFERRED EMBODIMENTS

Various inventive features are described below that can each be used independently of one another or in combination with other features.

Figure 1:
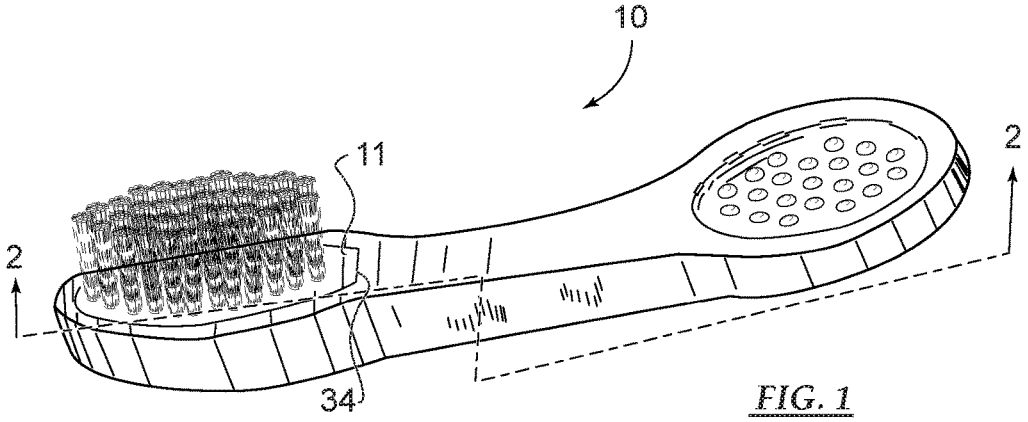
FIG. 1 is a perspective view of toothbrush embodiment made from a preferred method herein.

Initially, with reference to FIG. 1, a flexible handle toothbrush 10 is shown that particularly answers a need in the prison, hospital or institutional applications. As shown, the toothbrush 10 has an inner toothbrush head 11 made with a first material. The first material is ideally comprised of a rigid polymer material, therefore providing structural integrity to the toothbrush 10 head 20 allowing for attachment of bristles 14, via the bristle holes 13, in the manufacturing process. Further, an outer toothbrush head 12 is manufactured from extrudable elastomer material, e.g. thermoplastic material, thereby making this material 12 soft and pliable, hence, safer for prison environments or patient care institutions. Additionally as shown, a handle portion 61 is comprised of the same flexible material as the outer toothbrush head 12.

Figure 2:
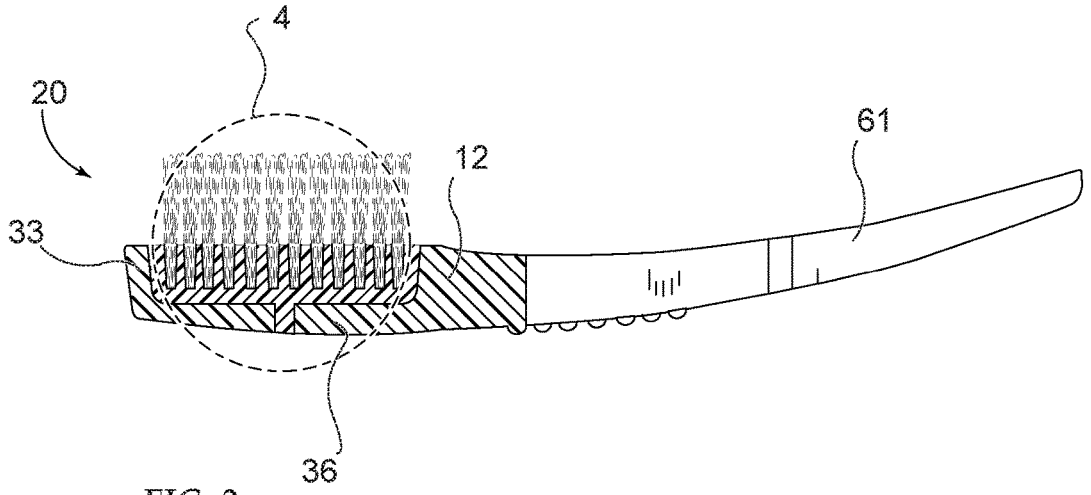
FIG. 2 is a profile view with a partial sectional view thereof taken along line 2-2 in FIG. 1 and in FIG. 3.
Figure 3:
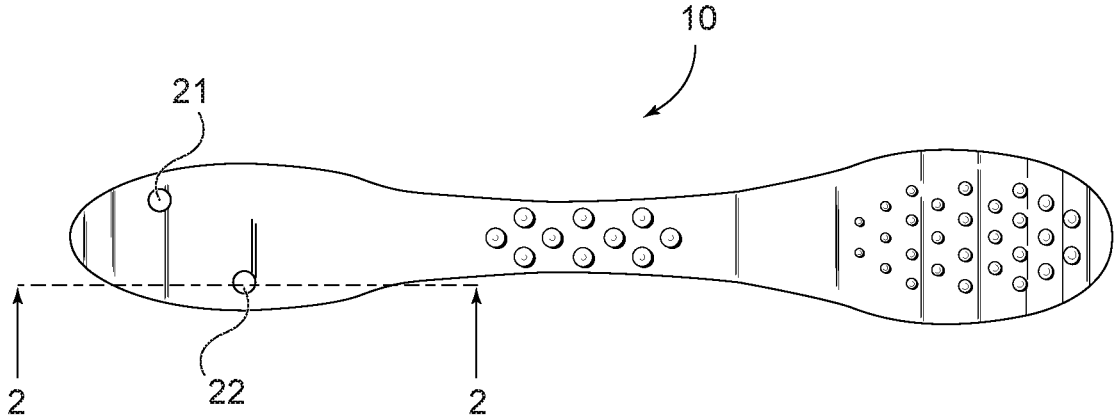
FIG. 3 is a top plan view of the toothbrush embodiment.

With regard to FIG. 2, a profile of the toothbrush 10 is provided with a partial sectional view thereof taken along line 2-2 in FIG. 1 and in FIG. 3. This together with FIG. 4, the composite toothbrush head 20 is shown with inner 11 and outer 12 portions having a pair (or more, or at least one) of pins 21, 22 at the interface thereof. Importantly, two separate single cavity molds are employed and a method step of molding the inner toothbrush head 11 preceding a step of molding the outer toothbrush head 12. In molding the outer toothbrush head 12, the inner toothbrush head 11 is inserted inside the outer toothbrush head 12 (plus handle 61) mold. The outer toothbrush plus handle mold will have a cavity to receive the inner toothbrush head having a plurality of bristle holes drilled thereto. Importantly, the composite toothbrush head 20 is devoid of glue, as additionally detailed herein. Further, the manufacturing of the composite head 20 will employ two single cavity molds.

Figure 4:
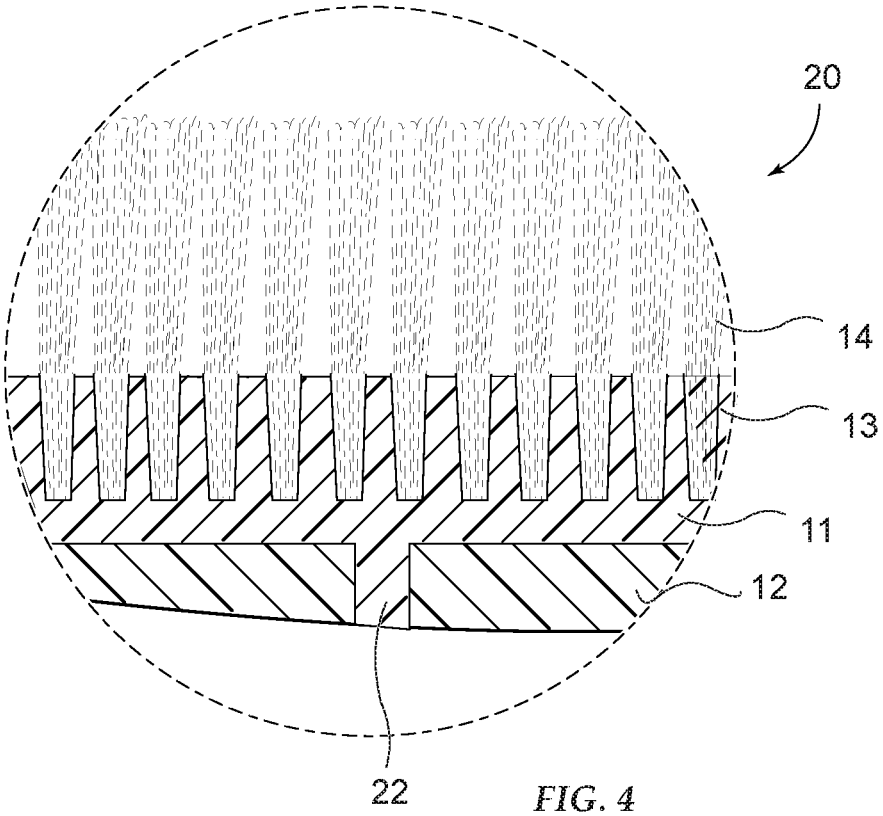
FIG. 4 is an enlarged view of an area circumscribed by line 4 in FIG. 2.

With regard to FIG. 3, a top plan view of the toothbrush is shown particularly illustrating placement of the interfacing pins 21, 22 of the present invention. As stated pin connectors 21, 22 are employed to strengthen the mating between inner 11 and outer 12 toothbrush head. More specifically, the pins 21, 22 are offset diagonally and equidistant with respect to a longitudinal axis of the flexible handle toothbrush 10, as shown. Also, with regard to the pins, they are further employed to maintain the inner head 11 stationary while positioned in the cavity of the outer head (plus handle) mold. Also as contemplated by the present invention, the two or more pins 21, 22 can be positioned anywhere along the interface between inner 11 and outer 12 heads, as long as the inner head stays stationary in the cavity portion of the outer head 12 mold. FIG. 4 provides an enlarged view of the interface between the inner 11 and outer 12 toothbrush heads.

Figure 5:
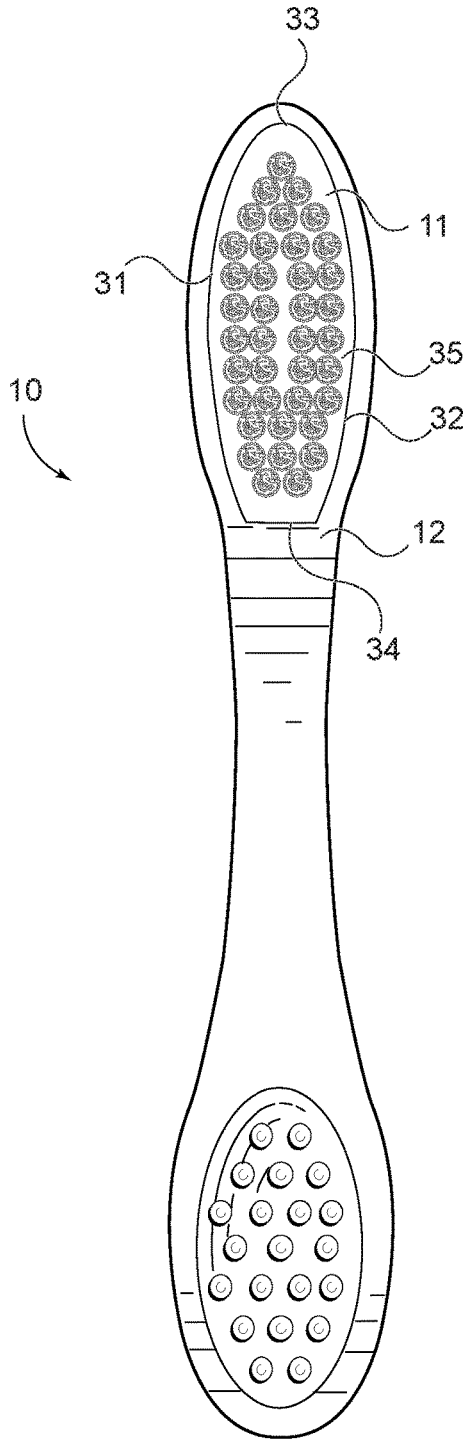
FIG. 5 is a bottom plan view of the toothbrush embodiment.

With regard to FIG. 5, the composite head 11, 12 is shown having a rigid inner core 11 that retains and holds a plurality of toothbrush bristles. The composite head rigid inner core 11 is made from a $1^{st}$ material. Generally, the inner core 11 is partially or wholly surrounded by softer material on various sides 31, 32, 33, 34, 36. Initially, the pliable flexible material surrounds the rigid inner core 11 on a left 31 and a right 32 side in the bottom plan view (FIG. 5) underside aspect; the pliable flexible material is particularly made from a $2^{nd}$ material forming the composite 11, 12. Also notably, the $2^{nd}$ material is cured around the $1^{st}$ material to provide a bond devoid of glue due to thermoplastic properties of the $2^{nd}$ material.

Further with regard to FIG. 5, a tip 33 of the rigid inner core 11 is covered with the pliable flexible material 12. The end 34 that transitions to the toothbrush handle 61 has pliable flexible material configured thereto. The end 34 of the rigid inner core is opposite the tip 33.

With further reference to FIG. 2 and FIG. 3, an opposite side 36 of the rigid inner core 11 is also substantially covered by pliable flexible material 12; in a preferred embodiment (FIG. 3), the opposite side 36 is covered with the exception of the pin connectors 21, 22 being made from the $1^{st}$ material. The opposite side 36 opposes a side 35 having the plurality of bristle holes 13. The pair of pin connectors 21, 22 extend from the opposite side 36 of the toothbrush inner head 11. The toothbrush inner head 11 could further be partially, substantially or wholly encased by the pliable flexible material. A notable exception would be the pin connectors 21, 22 and the side 35 having the plurality of bristles not being fully encased in the pliable flexible material.

Figure 6:
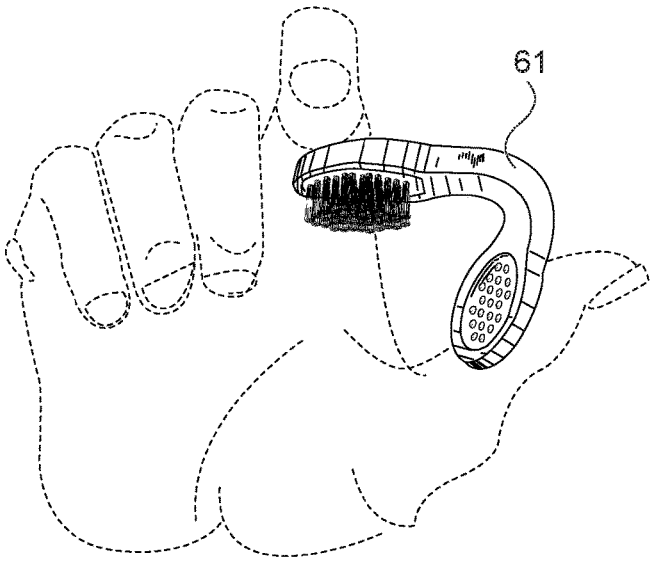
FIG. 6 is illustrative of a preferred position of a toothbrush.

With regard to FIG. 6, the preferred toothbrush has a flexible handle 61 at least partially (or wholly) made from the $2^{nd}$ material, the toothbrush thereby being a safety toothbrush suitable for prisons, institutions, or the like. As shown, the toothbrush can easily be bent into a shape of an "L," or a "C." More particularly, the flexible handle 61 has an enlarged curvilinear flat rear end portion and being comprised of flexible material thereby permitting the toothbrush to be flexed into substantially a "L" or "C" shape.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

While the particular Composite Head Toothbrush Having Safety Features as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

What is claimed is:

1. A toothbrush having a composite head, the composite head comprising:

a rigid polymer inner core having a plurality of bristle holes for retention and holding a plurality of toothbrush bristles, the rigid inner core made from a $1^{st}$ material;

a pliable flexible material completely surrounding the rigid inner core on a left and a right side in bottom plan view underside aspect, the pliable flexible material being made from a $2^{nd}$ material; and a bond at an interface between the rigid inner core and the pliable flexible material surrounding the rigid polymer inner core, wherein further the rigid polymer inner core is molded to the pliable flexible material thereby forming the composite head having the bond.

2. The toothbrush having a composite head of claim 1, the composite head further comprising:

a tip of the rigid polymer inner core being covered with the pliable flexible material;

an end of the rigid polymer inner core opposite the tip further having the pliable flexible material adjacent thereto, the end of the rigid polymer inner core opposite the tip transitioning to a handle of the toothbrush;

an opposite side of the rigid inner core, the opposite side opposing a side having the plurality of bristle holes, the opposite side substantially covered by the pliable flexible material; and a pair of pin connectors extending from the opposite side of the rigid polymer inner core, the rigid polymer inner core thereby being substantially encased by the pliable flexible material with an exception of the pin connectors and the side having the plurality of bristles not being fully encased in the pliable flexible material.

3. The toothbrush having a composite head of claim 1, the pliable flexible material further comprising thermoplastic properties and further wherein the bond is devoid of glue due to the thermoplastic properties of the pliable flexible material.

4. A toothbrush having a composite head, the composite head comprising:

a rigid polymer inner core having a plurality of bristle holes for retention and holding a plurality of toothbrush bristles, the rigid polymer inner core made from a $1^{st}$ material;

a pliable flexible material substantially surrounding the rigid polymer inner core on a left and a right side in a bottom plan view underside aspect, the pliable flexible material being made from a $2^{nd}$ material; and a flexible handle, the flexible handle at least partially made from the $2^{nd}$ material, the toothbrush thereby being a safety toothbrush.

5. The toothbrush having a composite head of claim 4, the flexible handle further comprising an enlarged curvilinear flat rear end portion.

6. The toothbrush having a composite head of claim 4, the composite head further comprising:

a tip of the rigid polymer inner core being covered with the pliable flexible material;

an end of the rigid polymer inner core opposite the tip further having the pliable flexible material adjacent thereto, the end of the rigid polymer inner core opposite the tip transitioning to the handle of the toothbrush;

an opposite side of the rigid polymer inner core, the opposite side opposing a side having the plurality of bristle holes, the opposite side substantially covered by the pliable flexible material; and a pair of pin connectors extending from the opposite side of the rigid polymer inner core, the rigid polymer inner core thereby being substantially encased by the pliable flexible material with an exception of the pin connectors and the side having the plurality of bristles not being fully encased in the pliable flexible material.

* * * * *